United States Patent [19]

Terita

[11] Patent Number: 4,681,392

[45] Date of Patent: Jul. 21, 1987

[54] SWAGED COMPLIANT CONNECTOR PINS FOR PRINTED CIRCUIT BOARDS

[75] Inventor: Robert S. Terita, Trumbull, Conn.

[73] Assignee: Bead Chain Manufacturing Company, Bridgeport, Conn.

[21] Appl. No.: 853,890

[22] Filed: Apr. 21, 1986

[51] Int. Cl.[4] ..... H01R 13/428

[52] U.S. Cl. ..... 439/751; 439/84; 439/82

[58] Field of Search ..... 339/17 C, 220 R, 221 R, 339/221 M, 252 R, 252 P

[56] References Cited

U.S. PATENT DOCUMENTS

| | | | |
|---|---|---|---|
| 3,281,760 | 10/1966 | Oshima | 339/176 M |
| 3,783,433 | 1/1974 | Kurtz et al. | 339/17 C |
| 4,017,143 | 4/1977 | Knowles | 339/221 R |
| 4,066,326 | 1/1978 | Lovendusky | 339/221 M |
| 4,076,356 | 2/1978 | Tamburro | 339/17 C |
| 4,186,982 | 2/1980 | Cobaugh | 339/17 C |
| 4,206,964 | 6/1980 | Olsson | 339/221 M |
| 4,223,970 | 9/1980 | Walter | 339/17 C |
| 4,274,699 | 6/1981 | Keim | 339/176 MP |
| 4,464,009 | 8/1984 | Thaler | 339/221 R |
| 4,475,780 | 10/1984 | Walter et al. | 339/220 R |

FOREIGN PATENT DOCUMENTS

| | | | |
|---|---|---|---|
| 2127625 | 4/1984 | United Kingdom | 339/221 R |

*Primary Examiner*—Gil Weidenfeld
*Assistant Examiner*—Gary F. Paumen
*Attorney, Agent, or Firm*—Mattern, Ware, Stoltz & Fressola

[57] ABSTRACT

Compliant connector pins for interfering force fit insertion in plated through holes of printed circuit boards are formed as elongated segments of wire stock with chamfered ends, with a stamped central board-engaging portion having a central web and a pair of lateral wing flanges extending sidewise in both directions from one edge of the central web, each wing flange being curved toward the other, opposite edge of the web, thus providing the board-engaging portion of each pin with a cross-section in the shape of the lower case Greek letter epsilon. The ends of the curved wing flanges are stamped inwardly to provide the central board-engaging portion with tapered ends, facilitating force fit insertion of the pins in holes in printed circuit boards.

8 Claims, 8 Drawing Figures

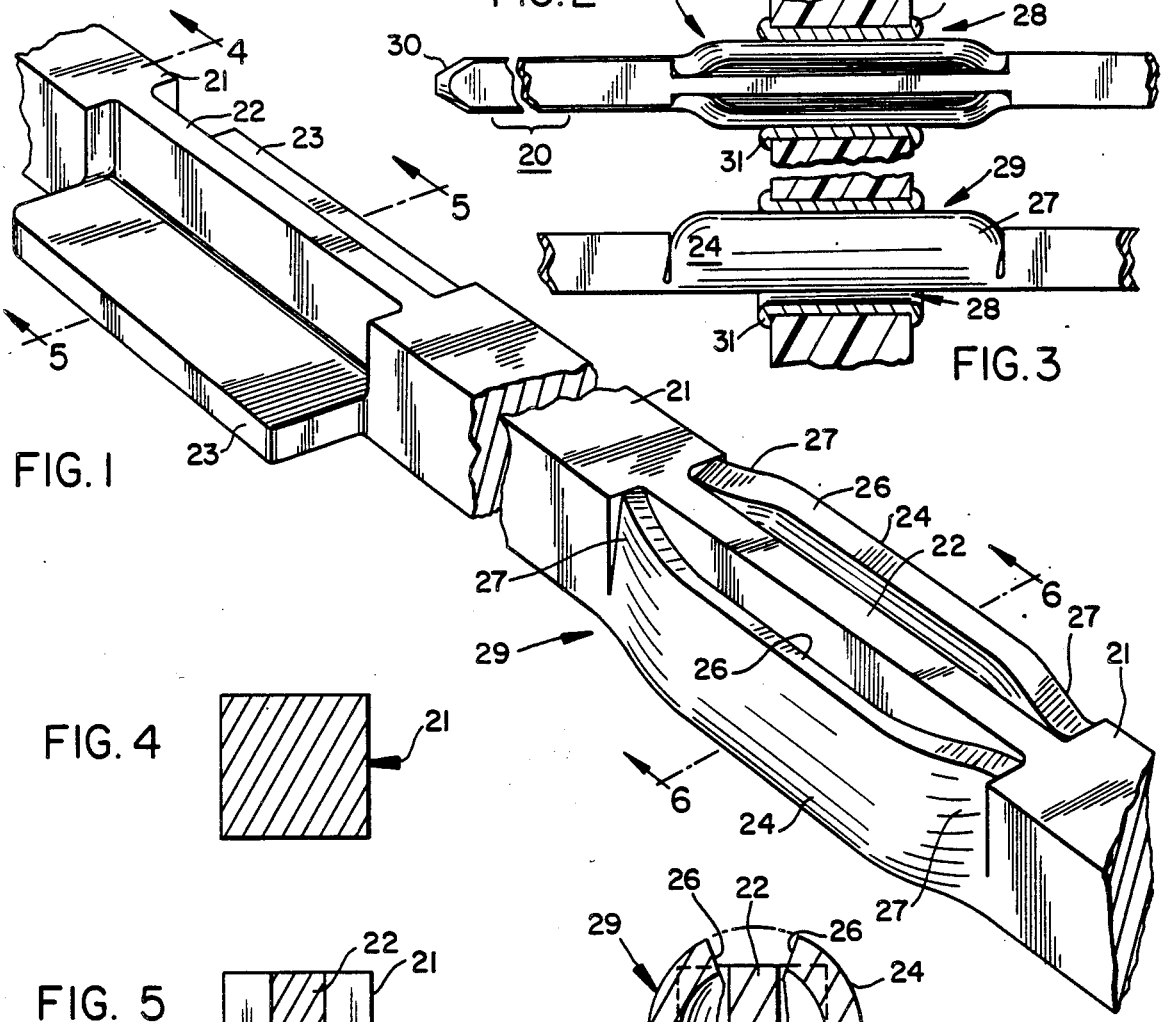
FIG. 1
FIG. 2
FIG. 3
FIG. 4
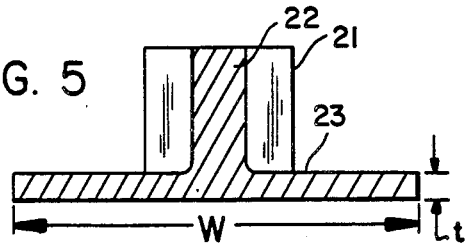
FIG. 5
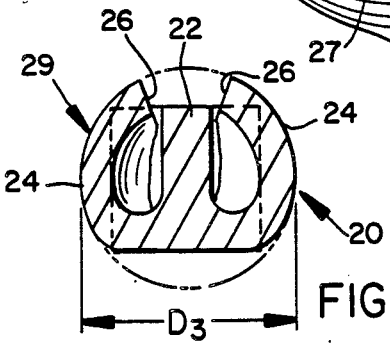
FIG. 8
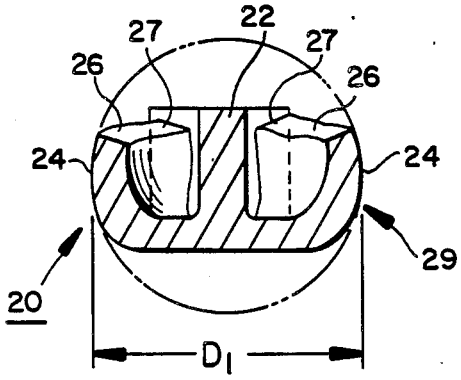
FIG. 6
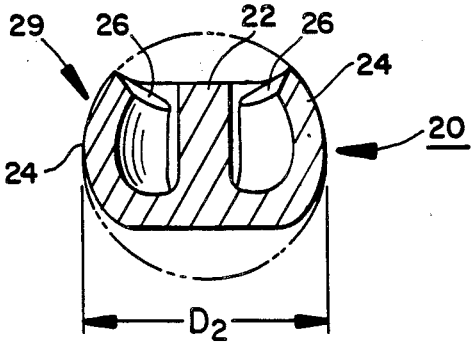
FIG. 7

SWAGED COMPLIANT CONNECTOR PINS FOR PRINTED CIRCUIT BOARDS

This invention relates to compliant connector pins or so called "solderless" connectors for insertion in plated holes of printed circuit boards, used for connecting external active and passive components to the circuit components and connections formed in one or more layers on the printed circuit board itself.

These press-fit wire-wrap pins normally range between 0.375" and 1.500" in length and they are normally formed of 0.025" or 0.045" square wire, with chamfered conically tapered or pyramidal blunt ends. The central portion, from 5% to 25% of the total pin length, is customarily flattened or deformed to produce an interfering press fit with the wall of a through hole in a printed circuit board.

Compliant pins may be fabricated of phosphor bronze, brass alloys, copper-nickel-tin alloys or other workable metals. They are plated with tin, tin-lead alloys, gold or palladium.

Many different patents have been granted on various proposals for fabricating printed circuit board connector pins. Irregular cross-sections of different kinds have been employed to permit deformation of the pin by the plated printed circuit board hole as the pin is telescopically inserted therein, assuring firm, sturdy mechanical and electrical contact between the connector pin and the plated hole in the printed circuit board Among the prior art patents believed to be most pertinent illustrating the interfering fit between compliant connector pins and plated printed circuit board holes, both of which are swagingly deformed in sliding relationship as the pin is inserted into the hole of the printed circuit board, are Olsson U.S. Pat. No. 4,206,964, Cobaugh U.S. Pat. No. 4,186,982, Lovendusky U.S. Pat. No. 4,066,326 and Kurtz U.S. Pat. No. 3,783,433. These patents show examples of slidingly deformable split connector pins having two-part offset cross-sections.

Another form of connector pin proposed in various prior patents has one or another of several different deformable cross-sections which may be "Z" shaped, "X" shaped or Sigma-shaped, as in Walter U.S. Pat. No. 4,475,780, Thaler U.S. Pat. No. 4,464,009, Keim U.S. Pat. No. 4,274,699 and Walter U.S. Pat. No. 4,223,970.

In addition, several connector pins have been proposed having cross-sections in the form of a split ring shaped like the letter "C", as in Tamburro U.S. Pat. No. 4,076,356 and Knowles U.S. Pat. No. 4,017,143. Different forms of thin walled cross-sections of wavy split tubes or compound cross-sections are typified by Oshima U.S. Pat. No. 3,281,760 and Kurtz U.S. Pat. No. 3,783,433. The drawings and texts of these various patents describe the press fit sliding insertion of the connector pin, telescoping within the plated through hole in the printed circuit board, and the resulting deformation of the pin and of the hole in each of these various pin configurations, creating the resistance to insertion of the pin and the resistance to withdrawal of the pin.

This deformation of the connector pins and of the plated walls of the printed circuit board holes in which the pins are installed normally exceeds elastic deformation and surpasses the yield point stress of the pin materials, making the deformation permanent and minimizing the withdrawal force required to remove the pins from the holes in which they are inserted.

Many of these proposed connector pins are provided with sharp corners or edges where deformation stress is concentrated, leaving substantial portions of the peripheral pin surface standing free without contact with the plated surfaces of the printed circuit board holes. Thus, in Thaler patent 4,464,009 only pin corner edges 16 are in contact with copper wall 3 of the bore comprising the connector receiving hole. The Sigma-shaped cross-section of the connector pin illustrated in the Thaler patent is relatively rigid while the bow tie shaped cross-section shown in the duPont Keim patent 4,274,699 is so weak at its central portion 38 that rupture may actually occur at that point, substantially reducing the elastic and resilient integrity of the pin cross-section The "C" shaped cross-sections characterizing Bell Telephone Laboratories' Tamburro patent 4,076,356 and Litton Systems' Knowles patent 4,017,143 offer considerable resilient flexibility, but lack the stiffness and rigidity contributed by a central bridge or web portion of the pin cross-section, such as that shown in Walter U.S. Pat. No. 4,475,780 or Thaler U.S. Pat. No. 4,464,009.

The number and variety of these prior art patents reflect continuing experimentation to seek a printed circuit board connector pin capable of resilient compliant flexing deformation, permitting firm insertion with maximum withdrawal resistance while maintaining its elastically deformed integrity for maximum contact force maintained between the pin and its plated hole.

The connector pins of the present invention are characterized by a cross-section resembling that of the lower case Greek letter epsilon, having a central web comprising the cross bar of the letter epsilon, a base flange forming a "T" shape with the central web and outer flange edges rolled toward each other and toward the central web to form hole-contacting outer peripheral surfaces which are flexibly deformable by the insertion force, to compress them together to the extent required for insertion, maintaining resilient deformation forces urging the rolled flanges toward the walls of the hole in which the connector pin is inserted, thus maximizing the retention force tending to resist withdrawal of the pin from the hole.

The connector pins of the present invention are thereby well adapted for insertion in holes of many different diameters, providing satisfactory withdrawal resistance over a wide variety of hole sizes.

Accordingly, a principal object of the present invention is to provide compliant connector pins suitable for installation in printed circuit board holes having a wide variety of internal diameters.

Another object of the invention is to provide such compliant connector pins with a cross-sectional shape having a relatively stiff central portion and flexible rolled flanges for resilient engagement with the walls of the printed circuit board connector holes in which they are inserted.

Still another object of the invention is to provide such compliant connector pins capable of convenient and economical manufacture in high volume production Other objects of the invention will in part be obvious and will in part appear hereinafter.

The invention accordingly comprises the features of construction, combinations of elements, and arrangements of parts which will be exemplified in the constructions hereinafter set forth, and the scope of the invention will be indicated in the claims.

For a fuller understanding of the nature and objects of the invention, reference should be had to the following detailed description taken in connection with the accompanying drawings, in which:

THE DRAWINGS

FIG. 1 is a fragmentary perspective view, broken to show successive stages in the fabrication of the compliant connector pins of the present invention.

FIG. 2 is a broken away top plan view of a pin of the present invention shown inserted in a plated through hole in a printed circuit board, with the board shown in cross-section for ease of illustration.

FIG. 3 is a corresponding broken away side elevation view of the same compliant connector pin inserted in its plated through hole in the printed circuit board, with the board again being shown in cross-section for ease of illustration.

FIG. 4 is a cross-sectional end elevation view of the square wire stock preferably employed in the fabrication of the compliant connector pins of the invention.

FIG. 5 is a cross-sectional end elevation view of the same square wire stock, taken along the plane 5—5 shown in FIG. 1, illustrating the first "coining" operation in the production of these connectors.

FIG. 6 a cross-sectional end elevation view taken along the plane 6—6 shown in FIG. 1 with the coined flanges of the stock formed in the view of FIG. 5 being shown rolled to form the epsilon-shaped cross-section having a diameter suitable for insertion in printed circuit board through holes of the largest anticipated internal diameter.

FIGS. 7 and 8 are corresponding cross-sectional end elevation views of the connectors of the present invention with their epsilon-shaped cross-sections being compressed by insertion in through holes of successively smaller diameters, illustrating the flexibility and range of hole sizes with which the connectors of this invention may be utilized.

BEST MODE FOR CARRYING OUT THE INVENTION

The epsilon-shaped cross-section compliant connector pins 20 characterizing the present invention and shown in the cross-sectional views of FIGS. 6, 7 and 8 are preferably formed from square wire stock such as the wire of cross-section 21 shown in FIG. 4. In the first forming or "coining" stage in the fabrication of the compliant pins of the invention, the lateral portions of the stock 21 are subjected to a cold-forming or stamping operation between coining dies, leaving a central web portion 22 of the stock 21 substantially unchanged, with a rectangular cross-section as shown in FIG. 5, while simultaneously producing laterally extending lower flanges 23 protruding from each side of the lower portion of the square stock 21. In the preferred embodiment, as shown in FIG. 1, both flange portions 23 are substantially rectangular shaped, with the coining or stamping dies displacing the material from both sides of the cross-section of square wire stock 21 from its normal position to a flattened lower laterally extending position producing a T-shaped cross-section 22–23 as illustrated in FIG. 5.

The length of the square wire stock 21 which is actually coined comprises only the central 5% to 25% of the total length of each compliant pin. The retaining uncoined ends of each pin comprise 75% to 95% of the pin's length, and these uncoined portions of the stock are broken away in the greatly enlarged views of the drawings.

The coining operation shown in the left-hand portion of FIG. 1 and in FIG. 5 is followed by a forming step in which flanges 23 are rolled upward and toward each other to positions illustrated in FIG. 6 and at the right-hand side of FIG. 1. In this configuration flanges 23 have been rolled upward into curved wing portions 24 with their outermost edges 26 flanking the upper portion of central web 22. As part of the forming operation, the ends of wing portions 24 closest to the uncoined square cross-section 21 are deformed inwardly into intimate engagement with the ends of the stamped recesses from which the material of flanges 23 was displaced in the coining operation.

As clearly shown in FIGS. 1 and 6, for example, these end portions 27 of the wings 24 are actually swaged down and inwardly toward each other closely flanking web 22 at its end portions. By this means, the outer surface of the formed epsilon-shaped cross-section, shown at the right-hand side of FIG. 1, offers no obstacle to the sliding insertion of the rolled cross-section portion of the pin into the plated printed circuit board hole 28 shown in FIGS. 2 and 3. A generally cylindrical or "lozenge-shaped" rolled segment 29 with tapered ends 27 thus becomes the flexible resiliently deformable board-engaging portion 29 comprising the central 5% to 25% of the compliant connector pins 20 of the present invention, as shown in the fragmentary views of FIGS. 2 and 3. In these FIGURES, rolled portion 29 is shown telescopically inserted and centered in the through hole 28 which is provided with an internal plated coating 31. In FIG. 2, the conically tapered left end 30 of the compliant pin is shown at the left side of the drawing. The pin ends have been omitted from the other views to allow the board-engaging central pin portion 29 to be shown greatly enlarged for maximum clarity of explanation.

An extremely thin plated coating, which may be 0.0001 inch in thickness or even less, applied to the connector pin apparently adds a "surface tension" or adhesion force to the friction or traction force between the rolled wings 24 and the interior of the plated through hole 28, substantially increasing the retention force tending to resist withdrawal of the inserted compliant pin 20 from its plated hole in the printed circuit board.

In the three successive view of FIGS. 6, 7 and 8, the rolled wings 24 of the rolled portion 29 are shown in successively more closely curved configurations produced by insertion of rolled portion 29 into telescopic engagement with plated through holes of successively smaller internal diameters. Thus, in the view of FIG. 6 internal diameter D1 may be as large as 0.047 inches, engaging an epsilon cross-section 29 formed from the original square wire stock, 0.025 inches by 0.025 inches, in which the intermediate coined stage shown in FIG. 5 has typical dimensions of web 22 about 0.009 inches in thickness while flange 23 is about 0.067 inches in width and between 0.004 and 0.007 inches in thickness.

In FIG. 7 the epsilon-shaped cross-section 29 is shown with its wing flanges 24 compressed toward each other by a smaller printed circuit board hole having an internal diameter D2 of about 0.042 inches. In the cross-section view of FIG. 8, the same compliant pin connector 20 has its epsilon shaped cross-section wing portions 24 curled together substantially to the maximum possible extent, with the edges 26 of wing portions 24 approaching contact with the upper portion of web 22 as a result of its resilient flexing deformation by insertion into a printed circuit board hole having an internal diameter D3 as small as 0.037 inches.

C-shaped cross-section compliant pins such as those shown in Tamburro 4,076,356 and Knowles 4,017,143 may exhibit withdrawal resistance to forces amounting to 50% or less of the original insertion force required to install the compliant pin. It has been found that the epsilon-shaped cross-section compliant pins 20 of the present invention achieve much higher retention forces opposing their withdrawal. This is believed to be caused by the relative stiffness of the epsilon shaped cross-section with its central web 22, and the fact that the rolled wing flanges 24 provide flexing resistance to the deformation imposed by telescoping insertion of the compliant pin within the printed circuit board hole. If pin materials of sufficiently high modulus of elasticity are employed, the compliant pins of the present invention are not stressed beyond their yield point during insertion, and this insures that elastic flexing forces created by insertion continue to hold the pin in its installed position and resist withdrawal, thus achieving retention forces of 80% to 90% of the original insertion force, and making the pins 20 of the present invention unexpectedly economical and effective for their intended purposes.

It will thus be seen that the objects set forth above, and those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A compliant connector pin for interfering force fit insertion in a plated through hole of a printed circuit board, formed entirely from original wire stock in coining and forming operations producing substantially no scrap, comprising an elongated segment of wire stock with chamfered wire-wrap ends, having its original maximum wire stock diameter selected to be less than the internal diameter of each said through hole, a stamped board-engaging portion formed at an intermediate point between said chamfered ends of said segment, with an extended cross-section having a maximum dimension exceeding the internal diameter of each said through hole, said board-engaging portion being formed with a central web extending substantially across the full width of the wire stock, and with a pair of lateral wing flanges of substantially uniform thickness between about 44% and about 78% of the thickness between of the central web and extending cantilever-fashion in two opposite directions from a first side of said central web, said central web remaining substantially undeformed during and after the stamping of said wing flanges, each of said wing flanges being smoothly curved toward the other, opposite side of the web, whereby the stamped board-engaging portion of said elongated segment is formed with a cross-section in the shape of the Greek letter epsilon.

2. The compliant connector pin defined in claim 1, wherein the wire stock has a square cross-section whose diagonal dimension is less than the internal diameter of each said through hole.

3. The compliant connector pin defined in claim 2, wherein said central web is substantially rectangular in cross-section.

4. The complaint connector pin defined in claim 3, wherein the central web comprises at least the central one-third of said square cross-section of the wire stock.

5. The compliant connector pin defined in claim 1, wherein said board-engaging portion constitutes between about 5% and about 25% of the total overall length of the pin.

6. The compliant connector pin defined in claim 1, wherein the chamfered pin ends are conical in shape, whereby endwise insertion of the pin in its through hole is facilitated.

7. The compliant connector pin defined in claim 1, wherein each end of said board-engaging portion is stamped inward at least flush with the original surface of the wire stock.

8. The compliant connector pin defined in claim 7, wherein the central board-engaging portion is lozenge-shaped, with tapered ends, and with said curved wing flanges forming the outer walls of the lozenge having a maximum transverse dimension exceeding the internal diameter of the through hole, and which outer walls are inwardly deflectable by wedging telescoping insertion within the internal wall of the through hole as the connector pin is compliantly installed in the printed circuit board.

* * * * *